US006679382B1

(12) United States Patent
Kancsar et al.

(10) Patent No.: US 6,679,382 B1
(45) Date of Patent: Jan. 20, 2004

(54) CHILD-RESISTANT PACKAGING FOR TABLETS

(75) Inventors: Peter Kancsar, Zurich (CH); Laurenz Zellweger, Zurich (CH); Michael Krohn, Zurich (CH); Claudia Schmauder, Zurich (CH); Susanne Marti, Zurich (CH)

(73) Assignee: Alcan Technology & Management Ltd., Neuhausen am Rhienfall (CH)

( * ) Notice: Subject to any disclaimer, the term of this patent is extended or adjusted under 35 U.S.C. 154(b) by 0 days.

(21) Appl. No.: 09/926,582

(22) PCT Filed: May 13, 2000

(86) PCT No.: PCT/EP00/04329

§ 371 (c)(1),
(2), (4) Date: Jun. 3, 2002

(87) PCT Pub. No.: WO00/75040

PCT Pub. Date: Dec. 14, 2000

(30) Foreign Application Priority Data

Jun. 2, 1999 (EP) ..... 99810481

(51) Int. Cl.[7] ..... B65D 83/04
(52) U.S. Cl. ..... 206/531; 206/538
(58) Field of Search ..... 206/528, 530, 206/531, 532, 538, 539, 820, 828

(56) References Cited

U.S. PATENT DOCUMENTS 3,302,777 A 2/1967 Sparks
3,912,081 A 10/1975 Haines et al.
4,422,551 A 12/1983 Pawlowski
4,666,040 A 5/1987 Murata
6,138,830 A * 10/2000 Muggli ..... 206/532

FOREIGN PATENT DOCUMENTS

FR 2227190 11/1974

* cited by examiner

*Primary Examiner*—Shian Luong
(74) *Attorney, Agent, or Firm*—Fisher, Christen & Sabol

(57) ABSTRACT

A child-resistant yet senior-friendly packaging for tablets, capsules or similar pharmaceutical products. The packaging is a blister pack (122) with at least one cup (134) that receives tablets (130) in an external package (120), arranged between a base part (124) and a cover part (128), and that is closed by a cover film (136) that can be pressed through. An intermediate part (126) is covered by a cover part (18). A first adhesive (30) is arranged between the base part (14) or the blister pack (122) and the base part (124). The intermeiae part (126) includes a first opening tongue (142) that is preferably linked with the intermediate part (126) via a first perforated line (144) so that it can be detached, and, within said first opening tongue (142), a second opening tongue (146) that is preferably linked with the first opening tongue (142) via a second perforated line (148) so that it can be detached. The second opening tongue (146) can be detached from the first opening tongue (142) once the first opening tongue (142) is removed from the intermediate part (126) and exposes the cover film (136).

20 Claims, 3 Drawing Sheets

CHILD-RESISTANT PACKAGING FOR TABLETS

Figure 1:
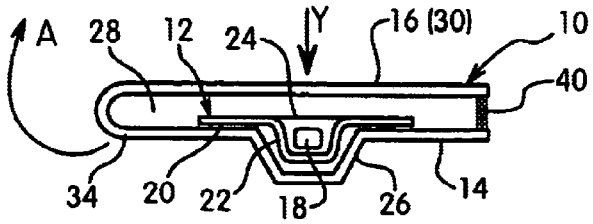

This is a 371 of International Application No. PCT/EP00/04329, field on May 12, 2000, that has benefit of European Patent Application No. 99810481.4, filed on Jun. 2, 1999.

The invention concerns a child-safe packing for tablets, capsules and similar pharmaceutical products, with a blister pack with at least one cup to hold the tablets or capsules sealed by a push-through cover film.

The danger of unsupervised consumption of drugs is undisputed, where in particular small children are greatly exposed to this potential risk especially when drugs are left lying around.

Blister packs have become the predominant form of packaging for tablets and capsules. Push-through packs, in which the tablets are pushed through a cover film from a cup in the base of the packing, have become very common. In other known blister packs a cover film is removed by peeling. Other blister packs have a notch as a tear aid.

The possibilities exploited today for increasing the child-safety of said blister packs for tablets and capsules consist of rendering opening more difficult by measures which require increased force, e.g. thicker push-through films, stronger adhesion of peel films or high tear resistance at tear notches.

Packs which can only be opened with increased use of force are indeed child-safe but can constitute a problem for the elderly.

The invention is therefore based on the task of providing a child-safe packing of the type described above which can be opened without difficulty by the elderly. This is essentially a matter of designing the packing in such a way that combination ability is required or simultaneous or complex movement sequences have to be performed.

To solve the problem in accordance with the invention therefore the blister pack is arranged in an outer pack between a base part and a cover part, and optionally an intermediate part is fixed between the blister pack and cover part or between the blister pack and base part, where the cover part and, if an intermediate part is provided, the intermediate part form an opening part which is removable from the cover part or from the intermediate part or from the cover film to expose the cover film.

Opening of the pack in accordance with the invention requires a combination ability in the sense that before pushing through the tablet at least one part has to be removed to expose the cover film.

Advantageously, the cup of the blister pack projects outward from the plane formed by the base part, where in the simplest case the cup of the blister pack penetrates an opening in the base part. If the base part is made of a moldable material, a cup can also be formed from this and the cup of the blister pack can be arranged in the cup of the base part.

In a preferred version of the packing according to the invention the opening part is preferably a tear-off strip connected to the cover part by means of a weakening line, especially a perforation line.

In a variant of the pack in accordance with the invention in which an intermediate part is placed between the blister pack and the cover part, the cover part may have a tear-off strip which is preferably detachably connected to the cover part by a first perforation line and which at least partially exposes the intermediate part.

The opening part can for example be a tear-off strip preferably connected to the intermediate part by way of a second perforation line.

The opening part may also be detachably connected to the cover film and removable from this by peeling. For this the opening part can for example be connected to the cover film by means of an adhesive or form a separable laminate together with the cover film.

In a particularly low cost production variant the outer pack consists of a single cut-out.

A double pack can easily be made from two part pickings arranged mirror symmetrically.

In a further variant of the packing according to the invention with an intermediate part placed between the blister pack and the cover part, a first opening tab can be arranged, preferably detachably connected to the intermediate part by way of a first perforation line, and inside the first opening tab can be placed a second opening tab, preferably detachably connected to the first opening tab by means of a second perforation line to form the opening part, where the second opening tab is detachable from the first opening tab after the first opening tab has been detached from the intermediate part to expose the cover film.

At least two packs can be joined together to form multi-portion packs, where the individual packs arranged next to each other form a multi-strip pack and are preferably detachable from the strip pack along a weakening line, preferably a perforation line.

For production of the packing according to the invention, rigid, semi-rigid and flexible materials known today for the production of packing, in the form of sheets, films, laminates or other layer materials in a thickness from a few mm to a few mm, preferably 8 mm to 3 mm, can be used. Examples of film-like materials are metal foils such as aluminum foil. Other examples of film-like materials are paper, semi-cardboard and cardboard. Particularly important are plastic-containing films, e.g., those based on polyolefins such as polyethylenes or polypropylenes, polyamides, polyvinyl chloride, polyesters such as polyalkylene terephthalates and, in particular, polyethylene terephthalate. The plastic-containing films can be monofilms of plastics, laminates of two or more plastic films, laminates of metal and plastic films, laminates of papers and plastic films or laminates of paper and metal and plastic films. The individual layers of the film-like materials can be attached to each other by means of adhesives, pastes, adhesive promotion agents and/or by extrusion coating, coextrusion or laminating, etc. Suitable plastic films are, for example, non-oriented or axially or biaxially oriented monofilms or laminates of two or more non-oriented or axially or biaxially oriented films of plastics based on polyolefins such as polyethylenes or polypropylenes, polyamides, polyvinyl chloride, polyesters such as polyalkylene terephthalates and, in particular, polyethylene terephthalate, cyclo-olefin-copolymers (CO) and polychloro-trifluoroethylene (PCTFE, trademark ACLAR).

Particularly suitable for the base parts of blister packs are transparent plastics with good molding properties such as polyethylene, polypropylene, cyclo-olefin-copolymers (COC), polyvinyl chloride, polyethylene terephthalate, polyamide and laminates made from said materials, e.g., PVC and polychloro-trifluoroethylene (PCTFE) or PVC and PVDC (polyvinyldichloride). For non-transparent blister packs, for example, laminates are used of an aluminum film coated on both sides with a plastic film with, for example, the structure polyamide/aluminum/PVC or pigmented plastic films. The cover film is usually an aluminum film of, for example, a thickness of 20 mm that can be painted and/or coated with a hot seal lacquer.

All of the above film-like materials such as paper, semi-cardboard, cardboard and plastic films in the form of monofilms, laminates, etc., can have at least one further continuous layer of ceramic materials sputtered or deposited from a vacuum in a thickness of approximately 5 to 500 nm (nanometers), for example, $Al_2O_3$ or $SiO_x$, where x is a number between 1.5 and 2. These layers of ceramic materials have barrier properties and prevent the diffusion of gases and water vapors through the packing.

Figure 2:
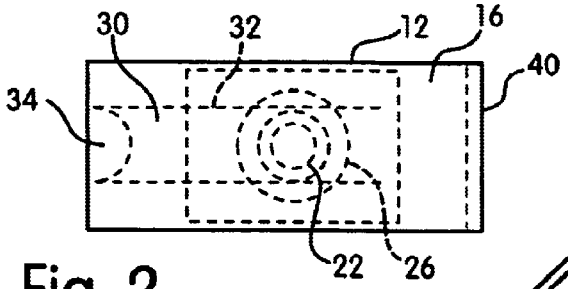
Figure 3:
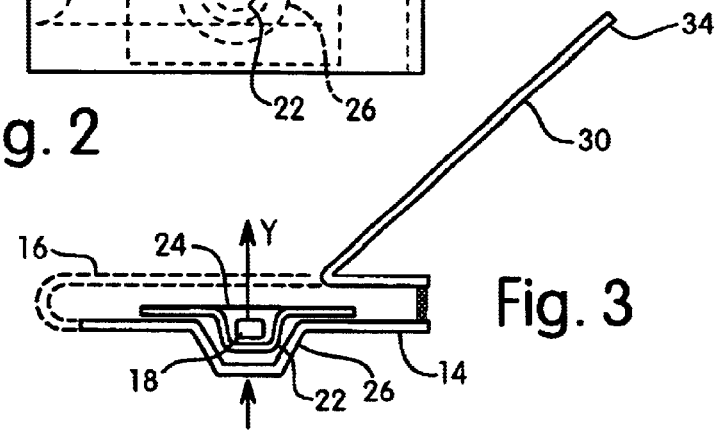
Figure 4:
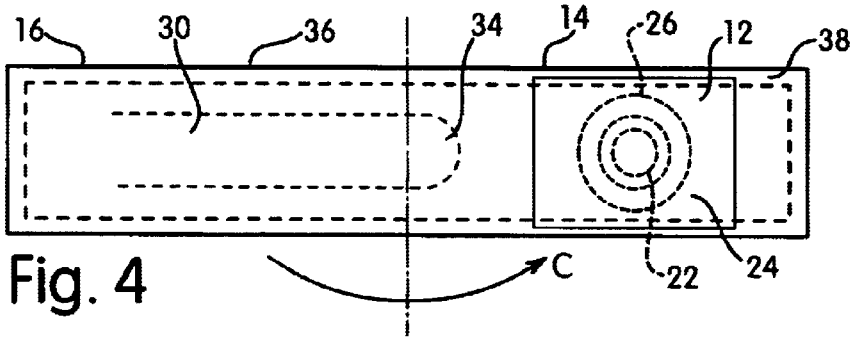
Figure 5:
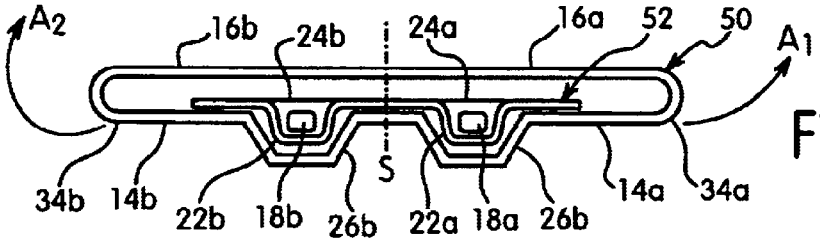
Figure 6:
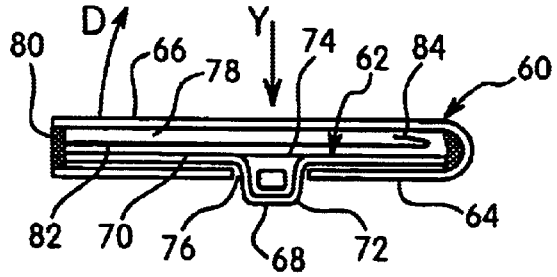
Figure 7:
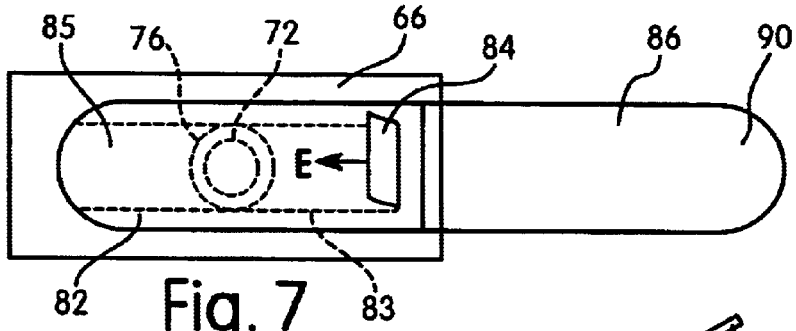
Figure 8:
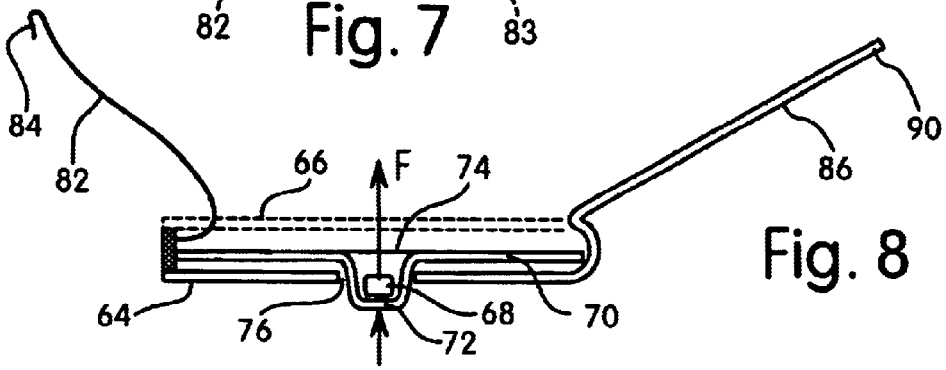
Figure 9:
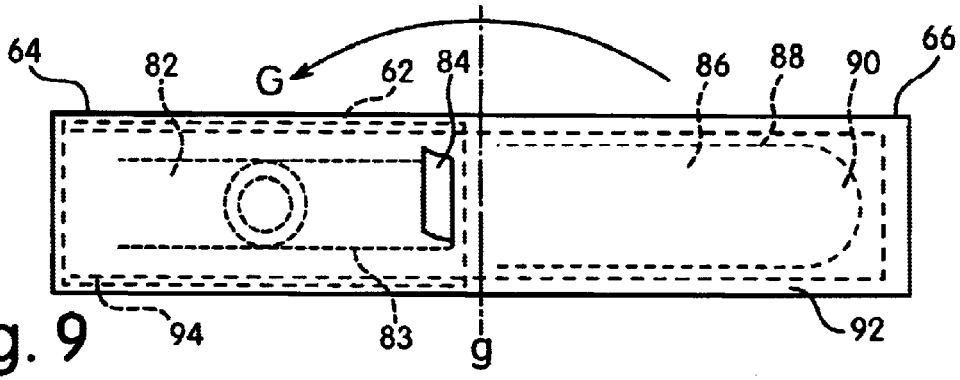
Figure 10:
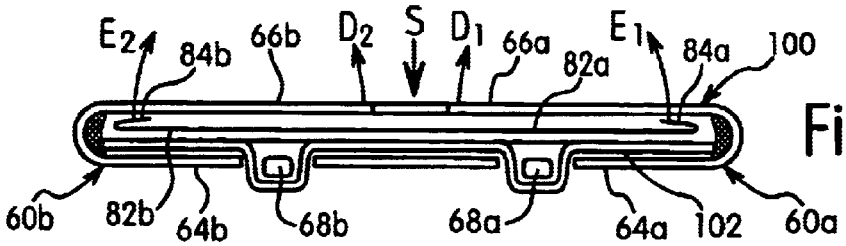
Figure 11:
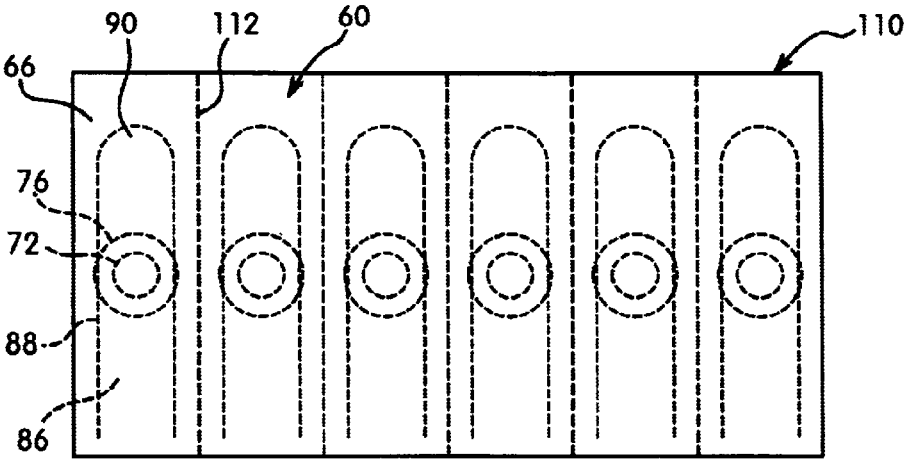
Figure 12:
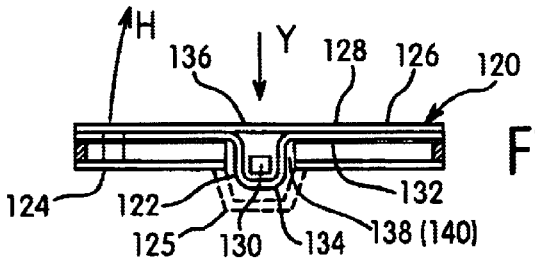
Figure 13:
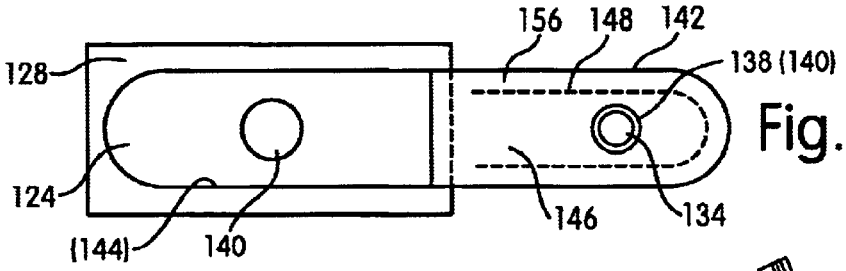
Figure 14:
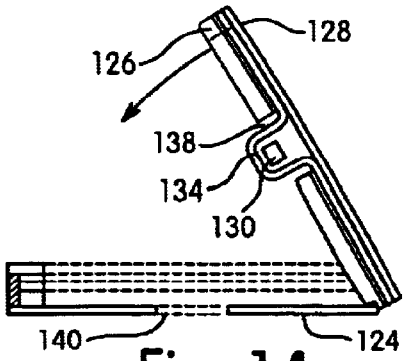
Figure 15:
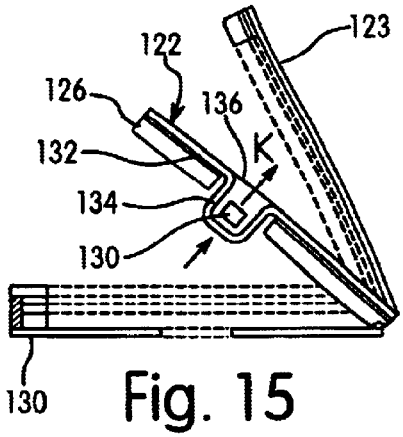

Further advantages, features and details of the invention arise from the description of preferred embodiments below and the drawings; these show diagrammatically FIG. 1 a longitudinal section through a first embodiment of a blister pack with an outer pack;

FIG. 2 a top view of the outer pack illustrated in FIG. 1 viewed in direction y;

FIG. 3 a longitudinal section through the partially opened blister pack with outer pack as shown in FIG. 1;

FIG. 4 a top view of a cut-out for manufacture of the outer pack as shown in FIG. 1;

FIG. 5 a longitudinal section through a blister pack of the same design as FIG. 1 with outer pack in the form of a double pack;

FIG. 6 a longitudinal section through a second embodiment of a blister pack with outer pack;

FIG. 7 a top view of the opened outer pack shown in FIG. 6 viewed in direction y;

FIG. 8 a longitudinal section through the partially opened blister pack with outer pack as shown in FIG. 6;

FIG. 9 a top view of a cut-out for manufacture of the outer pack as shown in FIG. 6;

FIG. 10 a longitudinal view through a blister pack of the same design as shown in FIG. 6 with outer pack in the form of a double pack;

FIG. 11 a top view of a blister pack with outer pack as shown in FIG. 6, designed as a multiportion pack;

FIG. 12 a longitudinal view through a third embodiment of a blister pack with outer pack;

FIG. 13 a top view of the opened outer pack as shown in FIG. 12, viewed in direction y;

FIG. 14 a longitudinal view through the partially opened blister pack with outer pack as shown in FIG. 12;

FIG. 15 a longitudinal view through the partially opened blister pack with outer pack as shown in FIG. 14 after a further opening step.

A first embodiment shown in FIGS. 1 to 4 of an outer pack 10 made, for example, from double- or multi-layer aluminum and polypropylene (PP) foil laminate for a blister pack 12 of essentially strip-like form has a base part 14 and a cover part 16. The blister pack 12—in the example shown as a single-portion pack for one tablet 18—has a base part 20 of, for example, polyvinylchloride (PVC) with a cup 22 molded in said base part to hold the tablet 18, and a cover film 24 made, for example, of aluminum sealed or glued to the base part 20. A further cup 26 projecting outward from the base part 14 of the outer pack 10 is provided in the base part 14 of the outer pack 10 to hold cup 22 of the blister pack 12. The base part 20 of blister pack 12 rests inside the base part 14 of the outer pack 10 and can, if necessary, be glued at least partially to the latter. Instead of the cup, the base part 14 may have only a base opening matched to periphery of cup 22 of the blister pack 12. Here the cup 22 penetrates the base opening and projects outwards from base part 14.

The cover part 16 of the outer pack 10 is connected as one piece to the base part 14 and with this forms a loop, where the cover part 16 and base part 14 lie approximately parallel opposite each other forming an intermediate space 28 to hold the blister pack 12 and connected together by adhesive points 40. As illustrated in FIG. 2, a tear-off strip 30 is integrated in the outer pack 10 and is detachable from the cover part 16 by means of a weakening line or perforations 32 arranged in linear form. The tear-off strip 30 runs across the cover part 16 and ends in the base part 14 with a tear-off tab 34. In the top view the tear-off strip 30 covers the cup 22 of the blister pack 12.

In order to remove the tablet 18, the tear-off tab 34 is first detached from the base part 14 along its perforation line 32 and the tear-off strip 30 is removed from the cover part 16 by performing an opening movement in the direction of the arrow A. This procedure exposes the cover film 24 of the blister pack 12 and consequently in this open position tablet 18 can be pushed through the cover film 24 by finger pressure in the direction of the arrow B on the cup 26 in the base part 14 and thus on the cup 22 of the blister pack 12, and ejected.

In the essentially strip-like cut-out for the outer pack 10 as illustrated in FIG. 4 the perforation line 32 indicates the weakened and therefore easily detachable connection between the tear-off strip 30 with tear-off tab 34 and the cover part 16 or the base part 14. The blister pack 12 is already resting on the base part 14, in other words the cup 22 of the blister pack 12 is positioned in the cup 26 in the base part 14 of the outer pack 10. The outer pack 10 is closed by folding the cover part 16 in the direction of the arrow C about a fold line c as far as the stop on the base part 14 and/or on the blister pack 12. This step causes at least partial adhesion of the edges 36 of the cover part 16 to the edges 38 of the base part 14 by way of adhesive points 40.

An outer pack 50 for a blister pack 52 illustrated in FIG. 5—in the example a two-portion pack for two tablets 18*a, b*—is essentially constructed of two outer packs 10 mirror-symmetrical to each other in accordance with FIG. 1. The same parts therefore carry the same references, the double configuration being expressed by a suffix a or b respectively. The base parts 14*a, b* are connected together as one piece by an adhesive point 54 and the cover parts 16*a, b* into the outer pack 50 forming a closed loop. In this closed position, the two part outer packs 10*a, b* lie either side of a mirror plane S. The two-part outer packs 10*a, b* can be opened in the same way and the tablets 18*a, b* removed in the same way as for the outer pack 10 illustrated in FIGS. 1 to 4.

A second embodiment illustrated in FIGS. 6 to 9 of an outer pack 60 made, for example, of cardboard for a blister pack 62 of essentially strip-like shape has a base part 64 and a cover part 66. The blister pack 62—in the example illustrated as a single portion pack for one tablet 68—has a base part 70 made, for example, of polyvinyl chloride (PVC) with a cup 72 molded from this to hold the tablet 68, and a cover film 74 of, for example, aluminum foil sealed or glued to the base part 70. The cup 72 of the blister pack 62 penetrates a base opening 76 in the base part 64 of the outer pack 60 that is matched to the periphery of cup 72, and projects outwards from the base part 64. The base part 70 of the blister pack 62 lies on the inside of the base part 64 of the outer pack 60 and may, if necessary, be at least partially glued to this. Instead of the base opening 76, if the material allows, a cup can also be molded from base part 64, i.e., in this case the cup 72 of the blister pack 62 would be held by the cup in the base part 64.

The cover part 66 of the outer pack 60 is connected as one piece with the base part 64 and with this forms a loop, where the cover part 66 and the base part 64 lie approximately parallel opposite each other forming an intermediate space 78 to hold the blister pack 62, and are connected to each other by adhesive points 80.

An intermediate part 82 made for example of polyethylene terephthalate (PET) film is arranged in the intermediate space 78 between the blister pack 62 and the cover part 66. A tear-off strip 85 is incorporated in the intermediate part 82 and is detachable from the intermediate part 82 by way of a weakening line or linear perforations 83. The free end of the tear-off strip 85 is laid in a loop to form a grip tab 84.

A tear-off strip 86 is incorporated in the outer pack 60 and is detachable from the cover part 66 by way of a weakening line or linear perforations 88. The tear-off strip 86 runs over the cover part 66 and ends at its free end in a tear tab 90. The tear-off strip 86 covers the cup 72 in the blister pack 62 when viewed from above. In order to remove the tablet 68, the tear-off strip is first separated from the cover part 66 in the area of the tear tab 90 along the perforation line 88 and removed from the cover part 66 by means of an opening movement performed in arrow direction D. In this procedure the intermediate part 82 together with its integrated tear-off strip 85 is exposed, enabling the pull tab 84 to be seized and the tear-off strip 85 to be removed by separating along the perforation line 83 in arrow direction E. This exposes the cover film 74 of the blister pack 62 and in this open position the tablet 68 can then be pushed through the cover film 74 by finger pressure on the cup 72 in arrow direction F and ejected.

In the embodiment shown in the drawing, the intermediate part 82 consists of a separate film fixed only in the edge areas. A further possibility consists of joining the intermediate part detachably directly to the cover film 74 such that the cover film 74 is exposed when the intermediate part or part thereof is pulled off. In the simplest case, the intermediate part consists of a peel-off strip connected to the cover film 74 by, for example, an adhesive. The intermediate part 82 can, however, also form a separable laminate with the cover film 74. An example of such a laminate is aluminum foil coated with hot sealing lacquer in a thickness from 20 to 50 mm, especially 20 to 30 mm, preferably 20 to 25 mm, the aluminum foil being coated with PET foil in a thickness of approximately 10 to 30 mm, especially 12 to 20 mm. The PET foil may have a further coating of paper. The intermediate foil 82 in this case, therefore, consists of PET foil or PET foil coated with paper which can be pulled off the aluminum cover film 74, i.e., can be peeled off.

The essentially strip-like cut-out for the outer pack 60 illustrated in FIG. 9 shows the weakened and therefore easily separable connection between the tear-off strip 86 together with the tear tab 90 and the cover part 66 as the perforation line 88. The blister pack 62 is already resting on the base part 64, i.e. the cup 72 penetrates the base opening 76. The outer pack 60 is closed by folding the cover part 66 in arrow direction G about a fold line g as far as the stop on the base part 64 or on the blister pack 62. This step causes at least partial adhesion of the edges 92 of the cover part 66 to the edges 94 of the base part 64.

An outer pack 100 for a blister pack 102 as illustrated in FIG. 10—in this example a two-portion pack for two tablets 68*a, b*—is essentially constructed of two outer packs mirror-symmetrical to each other in accordance with FIG. 6. The same parts are given the same references, where the double configuration is expressed by a suffix a or b. The base parts 64*a, b* are connected together as one piece by way of an adhesive point 96 and the cover parts 66*a, b* into an outer pack 100 forming a closed loop. In this closed position the two part outer packs 60*a, b* lie on either side of a mirror plane S. The two part outer packs 60*a, b* can be opened in the same way and the tablets 68*a, b* can be removed in the same way as for the outer pack 60 illustrated in FIGS. 6 to 9.

FIG. 11 shows a strip-like pack 110 with six individual packs according to FIG. 6 arranged next to each other. These can be separated from each other by way of linear perforations 112. The individual outer packs 60 can however also be opened without having to be separated from the strip pack 110. A strip arrangement of this kind is also suitable for the outer packs 100 with a two-portion blister pack 102 in accordance with FIG. 10.

An embodiment of an outer pack 120 for a blister pack 122 shown in FIGS. 12 to 15, of essentially strip-like form, is constructed in three layers with a base part 124, a superimposed intermediate part 126 and a cover part 128 on top of the intermediate part 126. The base part 124 and the cover part 128 are made, for example, of polyethylene terephthalate (PET) foils, the intermediate part 126 cardboard. The blister pack 122—in the example illustrated as a single portion pack for one tablet 130—has a base part 132 with a cup 134 molded in said base part to hold the tablet 130, and a cover film 136 of, for example, aluminum sealed or glued to the base part 132. The cup 134 of the blister pack 122 penetrates the openings 138 and 140 in the intermediate part 126 and/or in the base part 124 adapted to the periphery of the cup 134 and projects outward from the base part 124 of outer pack 120. The base part 132 of the blister pack 122 lies on the inside of the outer pack 120 and is at least partly glued to this. Instead of the base opening 140—where the material allows—a cup 125 can also be molded from the base part 124, i.e., the cup 134 of the blister pack 122 would in this case be held by the cup 125 in the base part 124. The cup 125 is shown in FIG. 12 in interrupted lines.

As shown in FIG. 13, a first opening tab 142 is integrated in the intermediate part 126 and detachable from the intermediate part 126 by means of a first weakening line or linear perforations 144. Inside the first opening tab 142 and also in the intermediate part 126 is integrated a second opening tab 146 which is detachable from the first opening tab 142 by way of a second weakening line or second linear perforations 148. The two perforation lines 144, 148 are separated from each other by an intermediate web 156.

The edges of the base part 124, the intermediate part 126 and/or the cover part 128 are at least partially glued to each other. The cover part 128 is also glued to the intermediate web 156 situated between the two perforation lines 144, 146, where the cover part 128 also has a perforation line 144 in the intermediate part 126 congruent with the first perforation line 144.

In order to remove the tablet 130, the opening tab 142 is first separated from the first opening tab 142 along its first perforation line 144 and raised from the intermediate part 126 by means of an opening movement in arrow direction H. In this position the second opening tab 146 can be separated along the second perforation line 148 and detached from the first opening tab 142. With this procedure the cover film 136 of the blister pack 122 is exposed so that in this open position the tablet 130 can be pushed through the cover film 136 by finger pressure on the cup 134 in the direction of the arrow K and ejected.

What is claimed is:

1. A child-safe packaging for tablets, capsules and similar pharmaceutical products, having a blister pack with at least one cup to hold tablets sealed by means of push-through cover film, in which between a base part and a cover part of an outer pack is arranged the blister pack, and between the blister pack and the base part is arranged an intermediate part, the edge parts of the base part, the intermediate part and the cover part, and also the blister pack and the intermediate part, are at least partly glued together, from the cover part and the intermediate part can be detached a first opening tab bordered by a first weakening line, and from the first opening tab can be detached a second opening tab bordered by a second weakening line, with the cover part and the intermediate part glued together in an area between the first and second weakening lines.

2. The packaging according to claim 1, wherein the weakening lines are perforation lines.

3. The packing according to claim 1, wherein the cup of the blister pack projects outward from the plane formed by the base part.

4. The packing according to claim 3, wherein the weakening lines are perforation lines.

5. The packing according to claim 3, wherein the cup of the blister pack penetrates an opening in the base part.

6. The packing according to claim 5, wherein the weakening lines are perforation lines.

7. A multi-portion pack of at least two packs in accordance with claim 5, wherein the individual pickings are arranged next to each other in a multi-strip pack.

8. The multi-portion pack according to claim 7, wherein the individual pickings are separable from the strip pack along a weakening line.

9. The multi-portion pack according to claim 8, wherein the weakening line is a perforation line.

10. The packing according to claim 3, wherein a cup is molded in the base part and the cup of the blister pack is arranged in a cup in the base part.

11. The packing according to claim 10, wherein the weakening lines are perforation lines.

12. A multi-portion pack of at least two packs in accordance with claim 10, wherein the individual pickings are arranged next to each other in a multi-strip pack.

13. The multi-portion pack according to claim 12, wherein the individual pickings are separable from the strip pack along a weakening line.

14. The multi-portion pack according to claim 13, wherein the weakening line is a perforation line.

15. A multi-portion pack of at least two packs in accordance with claim 3, wherein the individual pickings are arranged next to each other in a multi-strip pack.

16. The multi-portion pack according to claim 15, wherein the individual pickings are separable from the strip pack along a weakening line.

17. The multi-portion pack according to claim 16, wherein the weakening line is a perforation line.

18. A multi-portion pack of at least two packs in accordance with claim 1, wherein the individual pickings are arranged next to each other in a multi-strip pack.

19. The multi-portion pack according to claim 18, wherein the individual pickings are separable from the strip pack along a weakening line.

20. The multi-portion pack according to claim 19, wherein the weakening line is a perforation line.

* * * * *